US011244583B1

(12) United States Patent
Harris et al.

(10) Patent No.: US 11,244,583 B1
(45) Date of Patent: Feb. 8, 2022

(54) REALTOR SIGNPOST SYSTEM

(71) Applicant: Foldable Sign Post LLC, Bradenton, FL (US)

(72) Inventors: Frank Harris, Bradenton, FL (US); Joseph P. Corkins, Colorado Springs, CO (US)

( * ) Notice: Subject to any disclaimer, the term of this patent is extended or adjusted under 35 U.S.C. 154(b) by 0 days.

(21) Appl. No.: 17/090,424

(22) Filed: Nov. 5, 2020

(51) Int. Cl.
*G09F 15/00* (2006.01)

(52) U.S. Cl.
CPC ..... *G09F 15/0087* (2013.01); *G09F 15/0068* (2013.01)

(58) Field of Classification Search
USPC ..... 40/607.09, 607.05, 607.06
See application file for complete search history.

(56) References Cited

U.S. PATENT DOCUMENTS 3,892,081 A 7/1975 Goral
4,327,514 A * 5/1982 Bourque ..... G09F 7/18 40/606.19
4,357,772 A * 11/1982 Amick ..... G09F 7/18 248/159
4,524,533 A * 6/1985 Still, Jr. ..... G09F 7/18 248/156
4,793,083 A 12/1988 McDonald
4,825,575 A * 5/1989 Rethke ..... G09F 15/0062 248/533
4,916,840 A 4/1990 Getz
4,923,157 A * 5/1990 Belamiza ..... E04H 12/2261 248/156
5,024,410 A 6/1991 Ripley
5,340,065 A * 8/1994 Thomas ..... G09F 7/20 248/150
5,467,076 A 11/1995 Ruocco et al.
5,595,009 A * 1/1997 Rummer ..... G09F 7/00 40/607.05
7,077,366 B2 * 7/2006 Young ..... G03B 37/02 248/156
7,797,869 B2 * 9/2010 Tollis ..... G09F 15/0037 40/610
8,465,090 B1 * 6/2013 O'Connor ..... A47C 7/62 297/45
9,542,871 B1 * 1/2017 White ..... G09F 15/0056
2006/0016111 A1 1/2006 Simmons
2006/0042138 A1 3/2006 Lavelle
2006/0101690 A1 5/2006 Terbet
(Continued)

*Primary Examiner* — David R Dunn
*Assistant Examiner* — Christopher E Veraa
(74) *Attorney, Agent, or Firm* — Olav M. Underdal; IDP Patent Services

(57) ABSTRACT

A signpost system includes a signpost assembly, comprised of a vertical post and horizontal bar; hinge assemblies, which hingedly connect portions of the vertical post, such that the vertical post is foldable; sign hooks, each slidably attachable to the horizontal bar, such that varyingly sized signs can be hung from the horizontal bar; a post support assembly, which is detachably insertable into a ground surface; and a removable step bar, which can aid in the insertion of the post support assembly into the ground; whereby the post support assembly is insertable into the vertical post, such that signpost assembly is secured in an upright position by the post support assembly when inserted into the ground surface.

22 Claims, 6 Drawing Sheets

(56) References Cited

U.S. PATENT DOCUMENTS

| | | | | |
|---|---|---|---|---|
| 2006/0185203 | A1* | 8/2006 | Bittie | G09F 27/007 40/541 |
| 2007/0193842 | A1 | 8/2007 | Williams | |
| 2009/0012857 | A1 | 1/2009 | Schelfaut | |
| 2010/0043265 | A1 | 2/2010 | Amrani | |
| 2013/0232837 | A1 | 9/2013 | Guanill-Elukowich | |
| 2013/0318844 | A1 | 12/2013 | Ohnstad | |
| 2014/0034698 | A1 | 2/2014 | Cooper | |
| 2014/0075797 | A1* | 3/2014 | Urbina | G09F 17/00 40/607.01 |
| 2014/0345176 | A1* | 11/2014 | Okert | G09F 7/22 40/606.03 |
| 2015/0364064 | A1 | 12/2015 | Smith et al. | |
| 2016/0098947 | A1 | 4/2016 | Smith et al. | |
| 2017/0039899 | A1 | 2/2017 | Manos | |
| 2020/0111392 | A1 | 4/2020 | Wagnermarsh | |

* cited by examiner

Realtor Signpost System

REALTOR SIGNPOST SYSTEM

CROSS-REFERENCE TO RELATED APPLICATIONS

N/A.

FIELD OF THE INVENTION

The present invention relates generally to the field of sign systems, and more particularly to methods and systems for real estate sales signage.

BACKGROUND OF THE INVENTION

In the real estate field, it is common practice to have signs hung from signposts in the front yard of a property informing the public that the property is available for sale.

These signposts are typically made from 4×4 pieces of lumber joined together as a vertical post and horizontal arm. However, these wooden signposts are difficult to transport and install due to their weight and large size. Thus, realtors usually have to hire professional installers to install and remove the signposts. Lightweight metal signpost frames can also be used, but are often unattractive and difficult to assemble.

As such, considering the foregoing, it may be appreciated that there continues to be a need for novel and improved devices and methods for real estate signpost systems.

SUMMARY OF THE INVENTION

The foregoing needs are met, to a great extent, by the present invention, wherein in aspects of this invention, enhancements are provided to the existing model of realtor signpost systems.

In an aspect, realtor signpost system can include:

a) a signpost assembly, which can include:
   i. a vertical post; and
   ii. a horizontal bar, such that the horizontal bar can be configured to detachably attach to the vertical post;

b) a plurality of sign hooks, which can be configured to be slidably connected into the horizontal bar, wherein the plurality of sign hooks can be configured to detachably attach to a realtor sign, such that the realtor sign can be hung from the horizontal bar; and c) a post support assembly, which can be insertable into a ground surface;
   such that a lower end of the vertical post can be configured to be detachably attachable to the post support assembly, such that the vertical post can be secured in an upright position by the post support assembly, when the post support assembly is inserted into the ground surface.

In another aspect, the vertical post can include:

a) a plurality of post members; and b) a plurality of hinge cap assemblies, wherein each can include:
   i. a bottom hinge cap piece, which can be configured to be slidably attachable to an upper end of a respective lower post member; and
   ii. a top hinge cap piece, which can be configured to be slidably attachable to a lower end of a respective upper post member;
   such that the top hinge cap piece can be hingedly connected to the bottom hinge cap piece;

whereby the hinge cap assemblies can connect the post members, such that the post members form the vertical post;
such that the post members can be configured to rotate about the hinge cap assemblies, such that the vertical post can be foldable.

In yet another aspect, a post support assembly can include:

a) a stud member; and b) a ground spike, which is connected to a lower end of the stud member, such that the ground spike can be detachably insertable into the ground surface.

In a related aspect, the post support assembly can further include:

a removable step bar, which can be configured to be insertable into the upper receiving interior of the stud member, such that the removable step bar can be configured to be longer than the receiving interior, such that opposite ends of the removable step bar can protrude past the stud member;

wherein protruded ends of the removable step bar can be used as handles or steps to push the ground spike into the ground surface when the ground spike is attached to the stud member, such that the removable step bar can aid in the insertion of the ground spike into the ground surface.

In yet another related aspect, the post support assembly can further include:

a retention plate, which can be positioned between the stud member and the ground spike, such that the retention plate can prevent the stud member from being inserted into the ground surface.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
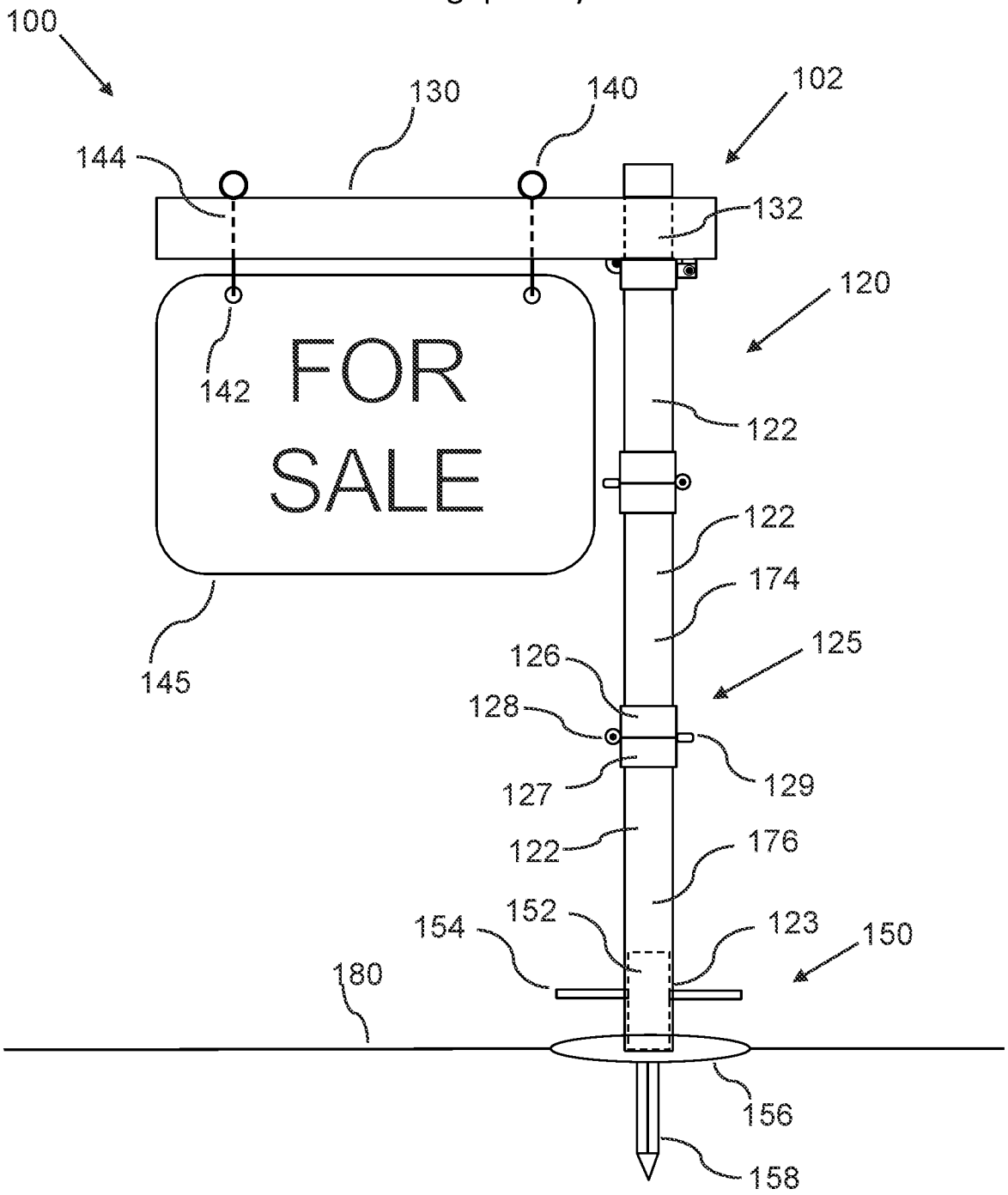
FIG. 1 is a front view of a realtor signpost system, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of a realtor sign post system 100, with reference to FIG. 1, in such manner that like reference numerals refer to like components throughout; a convention that we shall employ for the remainder of this specification.

In an embodiment, as shown in FIG. 1, a realtor signpost system 100 can include:

a) a signpost assembly 102, which can include:
   i. a vertical post 120; and
   ii. a horizontal bar 130, which can also be called a horizontal beam 130, such that the horizontal bar 130 can be configured to detachably attach to the vertical post 120, such that the horizontal bar 130 can be perpendicular to the vertical post; and b) a plurality of sign hooks 140, which can be configured to be slidably connected into the horizontal bar 130, wherein the sign hooks 140 can be configured to detachably attach to a realtor sign 145, such that the realtor sign 145 can be hung from the horizontal bar 130; and c) a post support assembly 150, which can be configured such that a lower end of the post support assembly is insertable into a ground surface 180;
   such that a lower end 123 of the vertical post 120 can be configured to be detachably attachable to an upper end of the post support assembly, such that the vertical post 120 can be secured in an upright position by the post support assembly 150, when the lower end of the post support assembly 150 is inserted into the ground surface 180.

In various related embodiments, the signpost system 100 can be used as a realtor signpost system 100, but can also be used for other purposes, such as for new construction sites wherein the signpost system 100 can be used to hold a permit box; and in other situations where it is convenient to mount an object to the signpost system 100.

Figure 2:
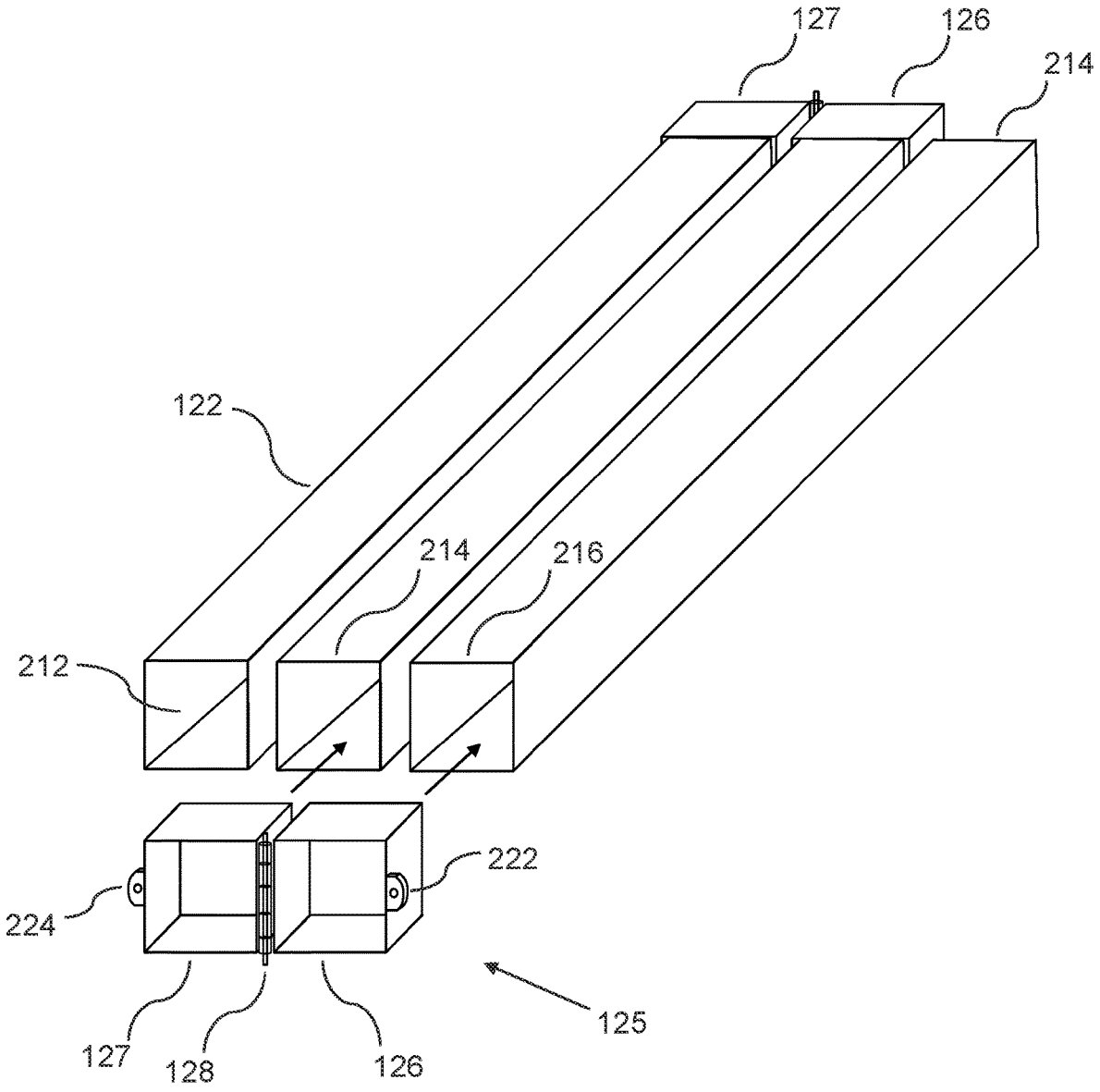
FIG. 2 is a perspective view of an assembly of a vertical post, according to an embodiment of the invention.
Figure 8A:
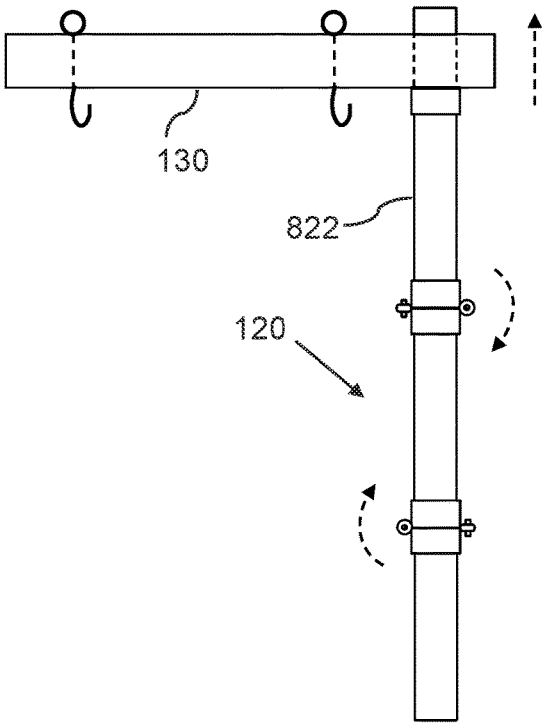
FIG. 8A is a front view of a sign post assembly, according to an embodiment of the invention.
Figure 8B:
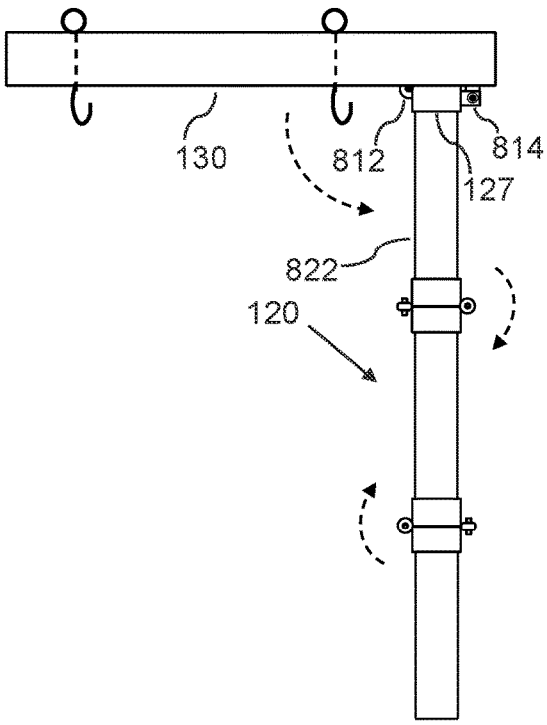
FIG. 8B is a front view of a sign post assembly, according to an embodiment of the invention.
Figure 8C:
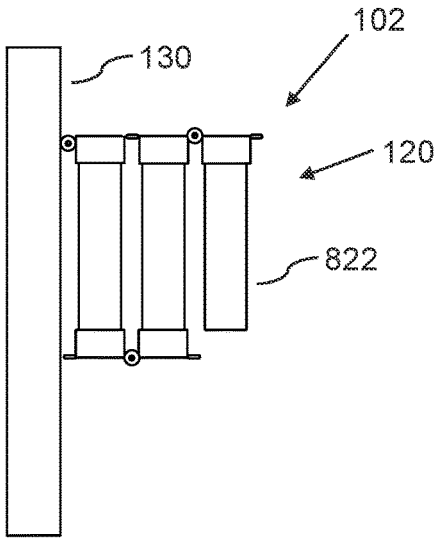
FIG. 8C is a top view of a folded sign post assembly, according to an embodiment of the invention.

In a related embodiment, as shown in FIGS. 1, 2, and 8C, the vertical post 120 can include:

a) a plurality of post members 122, which can include a protruding hollow interior 212, such that the hollow interior 212 can be accessible through an upper end 214 and a lower end 216 of a post member 122;
   whereby the post members 122 can be hingedly connected, with post hinges 128 and oppositely mounted post locks 129, such that the vertical post can be foldable for storage and transportation, as shown in FIG. 8C.

In another related embodiment, as shown in FIGS. 1 and 2, the vertical post 120 can further include:

a) a plurality of hinge cap assemblies 125, wherein each can include:
   i. a bottom hinge cap piece 127, which can be configured to be slidably attachable to an upper end of a respective lower post member 122, 176;
      wherein the bottom hinge cap piece 127 can be slidably inserted into the hollow interior 212 of the respective lower post member 122, 176 or slidably attached over the upper end of the respective lower post member 122, 176; and
   ii. a top hinge cap piece 126, which can be configured to be slidably attachable to a lower end of a respective upper post member 122, 174;
      wherein the top hinge cap piece 126 can be slidably inserted into the hollow interior 212 of the respective upper post member 122, 174 or slidably attached over the lower end of the respective upper post member 122, 174;
   such that the top hinge cap piece 126 can be hingedly connected to the bottom hinge cap piece 127;
   such that the upper and lower post members 122 can be configured to be rotatable about the hinge cap assemblies 125;
   such that the hinge cap assemblies 125 can hingedly connect the post members 122.

In yet another related embodiment, as shown in FIGS. 1, 2, 3A, 3B, 3C, 3D, 3E, and 3F, the hinge cap assembly 125 can include:

a) a top hinge cap piece 126, which can include:
   i. a top hinge cap body 311; and
   ii. a plurality of top hinge portions 310, which can protrude from a lower portion of a vertical surface 314 of the top hinge cap body 311, wherein the top hinge portions 310 can be configured as a circular cylinder, such that the central horizontal axis of the top hinge portions 310 can align with the bottom surface 317 of the top hinge cap piece;

wherein each top hinge portions 310 can include a top protruding hinge aperture 315, such that the top hinge aperture 315 can be accessible on either end of the top hinge portions 310; and b) a bottom hinge cap piece 127, which can include:

i. a bottom hinge cap body 321; and ii. a plurality of bottom hinge portions 320, which can protrude from an upper portion of a vertical surface 324 of the bottom hinge cap piece 127, wherein the bottom hinge portions 320 can be configured as a circular cylinder, such that the central horizontal axis of the bottom hinge portions 320 can align with the upper surface 327 of the bottom hinge cap piece 127; wherein each top hinge portions 320 can include a bottom protruding hinge aperture 325, such that the bottom hinge aperture 325 can be accessible on either end of the bottom hinge portions 320.

In a related embodiment, as shown in FIGS. 3A, 3B, 3E, and 3F, the top hinge portions 310 and bottom hinge portions 320 can be of equal length, and can be separated by that same equal length, such that the top hinge portions 310 can be configured to interlock with the bottom hinge portions 320, such that together the top hinge portions 310 and bottom hinge portions 320 can form a hinge assembly 128 equal to the length of the top hinge cap piece 126 and bottom hinge cap piece 127;

wherein the top hinge aperture 315 and the bottom hinge aperture 325 can be configured to positionally align, such that the hinge assembly 128 has a protruding receiving interior 332 accessible on either end.

Figure 3A:
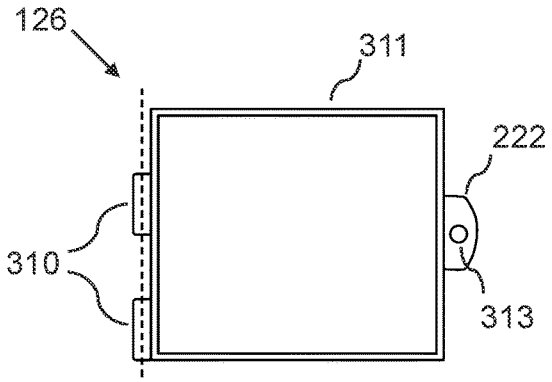
FIG. 3A is a bottom view of a top hinge cap piece, according to an embodiment of the invention.
Figure 3B:
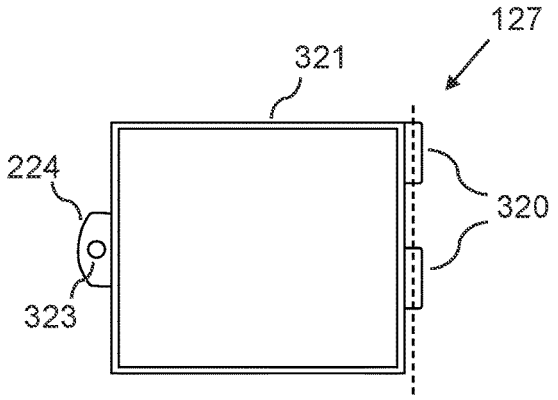
FIG. 3B is a top view of a bottom hinge cap piece, according to an embodiment of the invention.
Figure 3C:
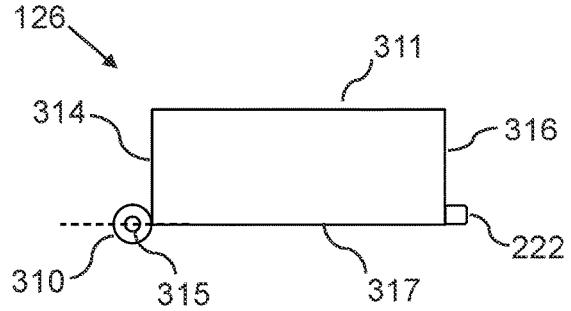
FIG. 3C is a front view of a top hinge cap piece, according to an embodiment of the invention.
Figure 3D:
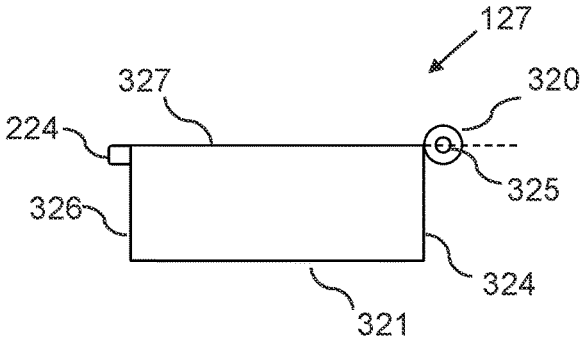
FIG. 3D is a front view of a bottom hinge cap piece, according to an embodiment of the invention.
Figure 3E:
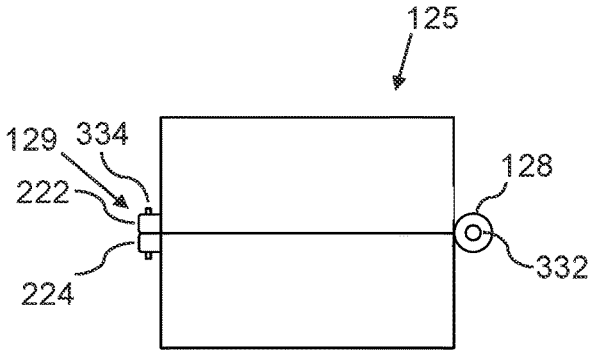
FIG. 3E is a front view of a hinge cap assembly, according to an embodiment of the invention.
Figure 3F:
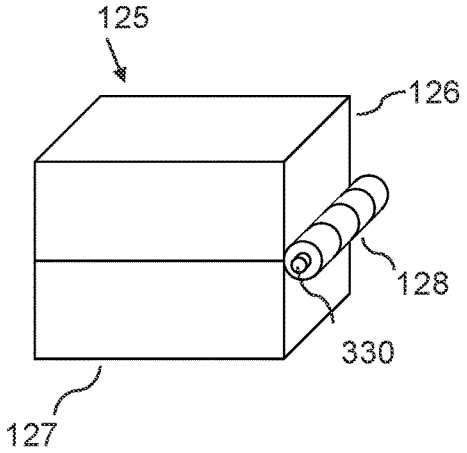
FIG. 3F is a perspective view of a hinge cap assembly, according to an embodiment of the invention.

In a related embodiment, as shown in FIG. 3F, each hinge cap assembly 125 can further include:

a hinge pin 330, which can be configured to match the protruding receiving interior 332 of the hinge assembly 128, such that the hinge pin 330 can secure the top hinge portions 310 and bottom hinge portions 320 of the bottom hinge cap piece 127 together;

wherein the top hinge cap piece 126 and bottom hinge cap piece 127 can be rotatable relative to the hinge pin 330.

In another related embodiment, as shown in FIGS. 3A, 3B, 3C, 3D, and 3E, each hinge cap assembly 125 can further include:

a) a top locking pin tab 222, which can be protruded from a lower portion of a vertical surface 316 opposite to the vertical surface 314 on which the top hinge portions 310 are positioned;

wherein the top locking pin tab 222 can include a top locking pin hole 313, which can be protruded through the top locking pin tab 222, such that the top locking pin hole 313 can be accessed on either end of the top locking pin tab 222; and b) a bottom locking pin tab 224, which can be protruded from an upper portion of a vertical surface 326 opposite to the vertical surface 324 on which the bottom hinge portions 320 are positioned;

wherein the bottom locking pin tab 224 can include a bottom locking pin hole 323, which can be protruded through the bottom locking pin tab 224, such that the bottom locking pin hole 323 can be accessed on either end of the bottom locking pin tab 224.

c) a locking pin 334, which can be configured to match the top locking pin hole 313 and the bottom locking pin hole 323, such that the locking pin 334 can be insertable into the top locking pin tab 222 and bottom locking pin tab 224;

whereby the top hinge cap piece 126 and bottom hinge cap piece 127 can be rotated, such that the top locking pin tab 222 and bottom locking pin tab 224 align, such that the top locking pin hole 224 and the bottom locking pin hole 323 can align, such that the locking pin 334 can be insertable through both the top locking pin tab 222 and the bottom locking pin tab 224, wherein the locking pin 334 can secure the top hinge cap piece 126 and the bottom hinge cap piece 127 in place.

Figure 5A:
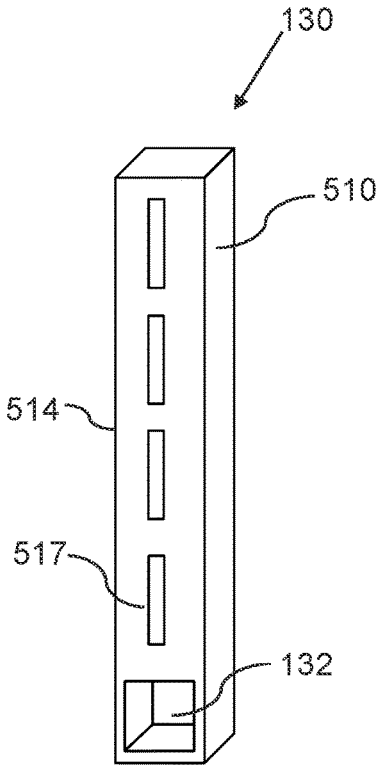
FIG. 5A is a top perspective view of a horizontal bar, according to an embodiment of the invention.
Figure 5B:
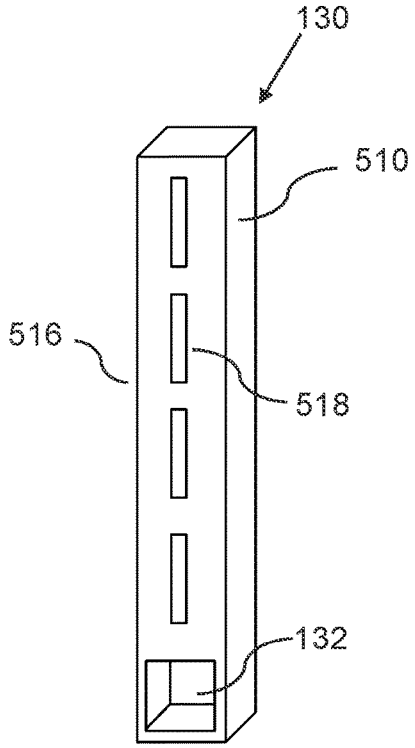
FIG. 5B is a bottom perspective view of a horizontal bar, according to an embodiment of the invention.
Figure 7:
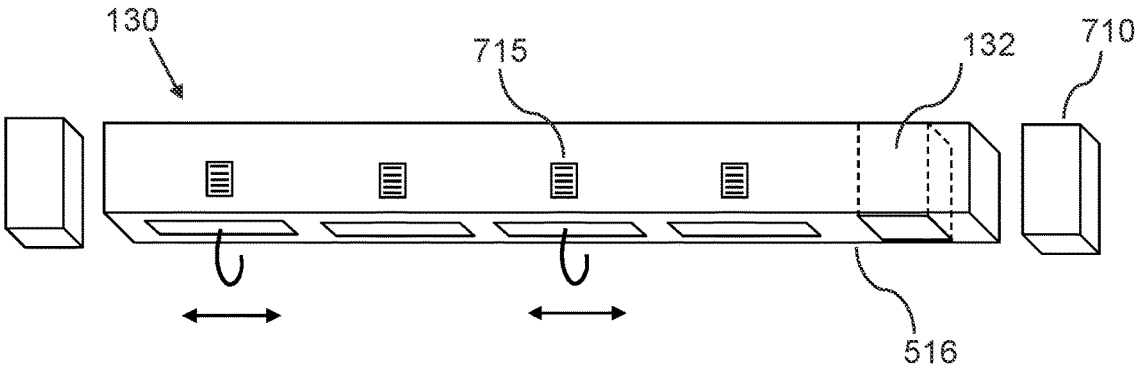
FIG. 7 is a front perspective view of a horizontal bar, according to an embodiment of the invention.

In a related embodiment, as shown in FIGS. 5A, 5B, and 7, the horizontal bar 130, which can be configured with a hollow interior 510, can include:

a) a vertically protruding aperture 132, which can protrude vertically through the horizontal bar 130, such that the vertically protruding aperture 132 can be configured to match the upper portion 122 of the vertical post 120, such that the vertical post 120 can be inserted into the vertically protruding aperture 132; and b) a plurality of lower apertures 518, which can be positioned on the lower surface 516 of the horizontal bar 130, such that the lower apertures 518 can provide access to the hollow interior 510 of the horizontal bar 130.

In a related embodiment, as shown in FIGS. 1, 5A, 5B, and 7, the vertically protruding aperture 132 of the horizontal bar 130, can be configured to match an upper portion 122 of a vertical post 120, such that the vertical post 120 can be insertable into the vertically protruding aperture 132;

wherein the signpost assembly further comprises: a bottom hinge cap body;

wherein a bottom hinge cap body 321 can be slidably attachable to an upper end 214 of the upper post member 122 of the vertical post 120, such that the bottom hinge cap body 321 can prevent the horizontal bar 130 from sliding down the vertical post 120, as shown in FIG. 1.

In a related embodiment, as shown in FIGS. 8A and 8B, the horizontal bar 130 can be attached to the vertical post 120 using two different methods:

a) the horizontal bar 130 can be slidably attachable to an upper post member 822 of the vertical post 120, as shown in FIG. 8A; or b) the horizontal bar 130 can be hingedly connected to the vertical post 120, wherein that the horizontal bar 130 can be hingedly connected to a bottom hinge cap piece 127, such that the bottom hinge cap piece 127 can be slidably attached to the upper post member 822 of the vertical post 120, wherein the horizontal bar 130 can be configured without a vertically protruding aperture 132, as shown in FIG. 8B;

whereby the horizontal bar 130 can include a set of protruding top hinge portions 310, such that the top hinge portions 310 of the horizontal bar 130 can be configured to interlock with bottom hinge portions 320 of the bottom hinge cap piece 127 to form a hinge connection 812, wherein a hinge pin 330 can be inserted into the hinge connection 812 to secure the horizontal bar 130 in place;

such that the horizontal bar 130 can rotate about the hinge connection 812.

In a further related embodiment, the signpost assembly 102 can further include:

a) a pin lock assembly 814, which is mounted on an opposite of the hinge connection 812, such that the pin lock assembly 814 can lock the horizontal bar 130 in a horizontal configuration.

Figure 8D:
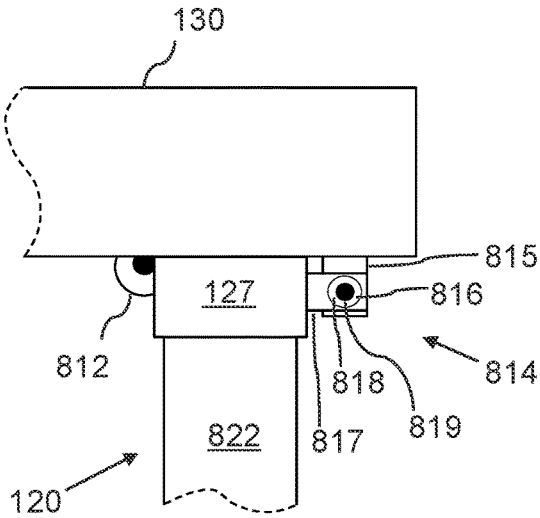
FIG. 8D is a front view of a portion of sign post assembly showing hinged mounting of a horizontal bar with a pin lock assembly, according to an embodiment of the invention.

In a yet further related embodiment, as shown in FIGS. 1, 8B, and 8D, the pin lock assembly 814 can further include:

a) a first lock flange 815, with a first flange aperture 816, such that the first lock flange 815 is connected to the horizontal bar 130;

b) a second lock flange 817, with a second flange aperture 818, such that the second lock flange 817 is connected to the horizontal bar the vertical post 120; and c) a lock pin 819;

wherein the first flange aperture 816 is aligned with the second flange aperture 818, when the horizontal bar 130 is in a horizontal configuration;

such that the lock pin 819 is inserted through the first flange aperture 816 and the second flange aperture 818 to lock the horizontal bar 130 is in the horizontal configuration.

In a related embodiment, as shown in FIG. 7, the horizontal bar 130 can be configured to include end caps 710, which can be attached to either end of the horizontal bar 130, such that the end caps 710 provide access to a storage cavity; wherein the end caps 710 can be hingedly mounted to either end of the horizontal bar 130.

In a further related embodiment, the horizontal bar 130 can be configured with a hollow interior 510, wherein the signpost system 100 can further include:

a) a first end cap 710, which is detachably attachable to a first/outer/left end of the horizontal bar 130; and b) a second end cap 710, which is detachably attachable to a second/inner/right end of the horizontal bar 130;

such that removal of at least one of the first end cap 710 and the second end cap 710 provides access to the hollow interior 510, which functions as a storage cavity 510.

In another related embodiment, as shown in FIG. 7, the horizontal bar 130 can include raised textual descriptions 715, such that the textual descriptions 715 can provide useful information such as numerical references.

Figure 6:
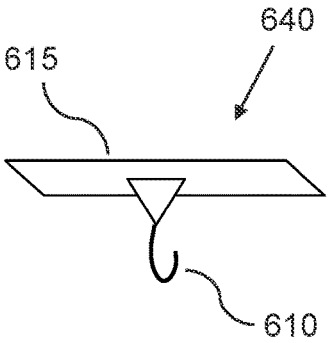
FIG. 6 is a perspective view of a sign hook, according to an embodiment of the invention.

In yet a related embodiment, as shown in FIGS. 1, 6 and 7, each of a sign hook 640 can include:

a) a rectangular plate 615; and b) a hook 610, which can be attached to a bottom side of the rectangular plate 615;

wherein the hook 610 can be configured to be insertable into a hook hole 142 of a realtor sign 145, such that the realtor sign 145 can securely hang from the hooks 610, as shown in FIG. 1.

In an embodiment, as shown in FIGS. 6 and 7, each rectangular plate 615 can be configured to be insertable into the lower apertures 518 of the horizontal bar 130;

wherein each rectangular plate 615 can be configured to have a length longer than the length of the lower apertures 518, such that the rectangular plate 615 can rest and be slid back and forth on the interior of the lower surface 516, such that the plurality of sign hooks 640 are slidably attachable to the horizontal bar 130;

wherein the rectangular plate 615 can be slidably mounted inside the horizontal bar 130, such that the hook 619 protrudes through a corresponding lower aperture 518 in the plurality of lower apertures 518;

whereby the sign hooks 640 can be slid to adjust to varyingly spaced realtor sign hook holes 142, such that the sign hooks 640 can be attached to varyingly sized realtor signs 145.

In an embodiment, as shown in FIGS. 1 and 5A, each of the sign hooks 140 can be configured to include an eyelet rod 144, such that the eyelet rod 144 protrudes through a plurality of upper apertures 517 on the upper surface 514 of the horizontal bar 130, such that the plurality of upper apertures 517 can positionally match the plurality of lower apertures 518;

whereby the eyelet rod 144 can be slid back and forth within the upper apertures 517, such that the eyelet rods 144 can be used to slide the sign hooks 140.

Figure 4A:
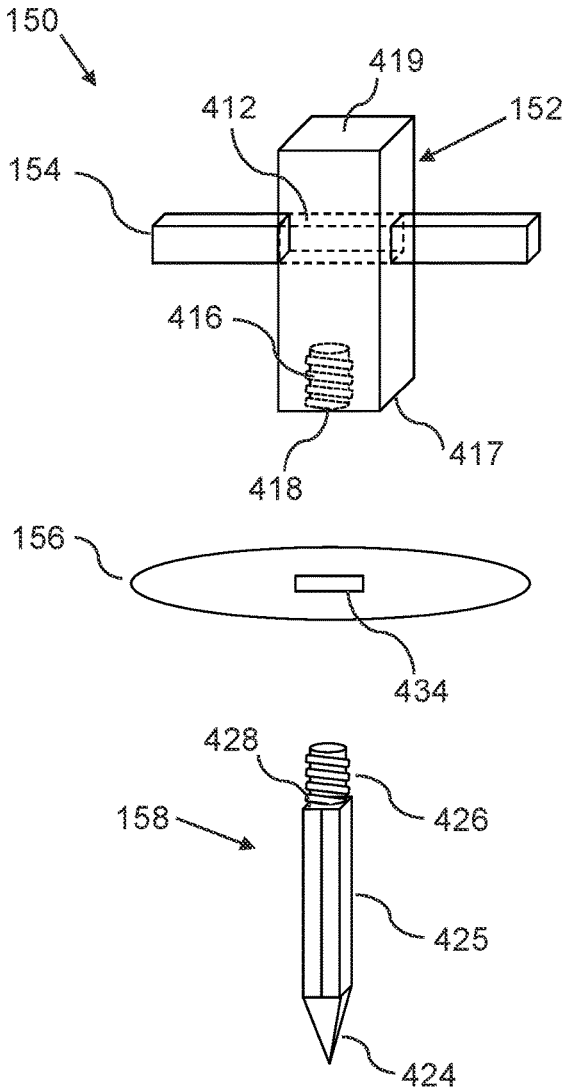
FIG. 4A is a perspective view of a disassembled post support assembly, according to an embodiment of the invention.
Figure 4B:
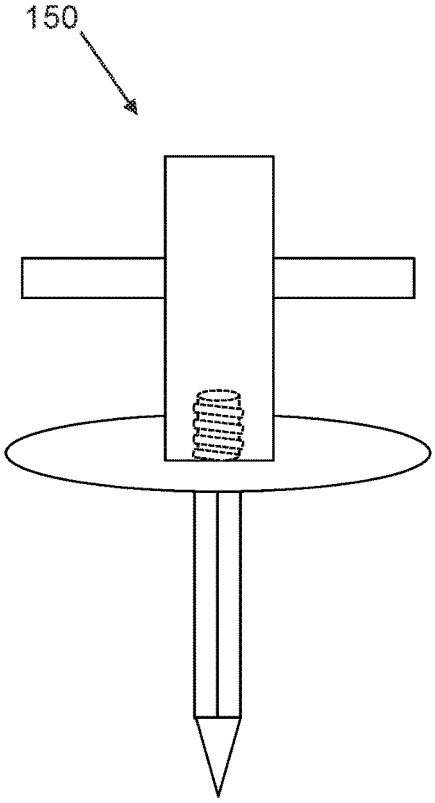
FIG. 4B is a front view of a post support assembly, according to an embodiment of the invention.

In an embodiment, as shown in FIGS. 1, 4A, and 4B, a post support assembly 150 can include:

a) a stud member 152, such that a lower end 123 of the vertical post 120 can be configured to be detachably attachable to an upper end 419 of the stud member 152, for example such that the vertical post 120 slides over the stud member 152; and b) a ground spike 158, which can be connected to a lower end of the stud member, such that the ground spike 158 can be configured to come to a sharp point 424, such that the sharp point 424 can puncture the ground surface 180, such that the ground spike 158 can be detachably insertable into the ground surface 180.

In a related embodiment, as shown in FIG. 4A, the stud member 152 can include:

a) a lower receiving interior 416; and b) a lower entry aperture 418 on a lower surface 417 of the stud member 152, which can provide access to the lower receiving interior 416;

wherein an upper portion 426 of the ground spike 158 can be configured to match the lower receiving interior 416 of the stud member 152, such that the upper portion 426 of the ground spike 158 can be detachably attachable to the stud member 152;

wherein the ground spike 158 can secure the stud member 152 in an upright position when the ground spike 158 is inserted into the ground surface 180.

In a related embodiment, as shown in FIGS. 4A and 4B, the lower receiving interior 416 of the stud member 152 can be configured as a threaded hole 416, and the upper portion 426 of the ground spike 158 can be configured as a threaded rod 426 that matches the lower receiving interior 416, such that the ground spike 158 can be secured to the stud member 152 by screwing the upper portion 426 of the ground spike 158 into the lower receiving interior 416 of the support stud.

In an embodiment, as shown in FIGS. 4A and 4B, the stud member 152 can further include:

a lateral aperture 412, which protrudes laterally/horizontally through the stud member 152; and wherein the post support assembly 150 can further include:

a removable step bar 154, which can be configured to be insertable into the lateral aperture 412, such that the removable step bar 154 can be configured to be longer than the lateral aperture 412, such that first and second protruding ends of the removable step bar 154 can protrude past the stud member 152;

wherein the first and second protruding ends of the removable step bar 154 can be usable as handles or steps, to push the ground spike 158 into the ground surface 180, when the ground spike 158 is attached to the stud member 152, such that the removable step bar 154 can aid in the insertion of the ground spike 158 into the ground surface 180.

In an embodiment, as shown in FIGS. 4A and 4B, the post support assembly 150 can further include:

a retention plate 156, which can be configured as a disk, such that the retention plate 156 can be positioned between the lower surface 417 of the stud member 152 and an upper surface 428 of a central portion 425 of the ground spike 158, such that the retention plate 156 can prevent the stud member 152 from being inserted into the ground surface 180;

wherein the retention plate 156 can include a centrally positioned hole 434, which can be configured to match the upper portion 426 of the ground spike 158 and the lower entry aperture 418 of the stud member 152, such that the upper portion 426 of the ground spike 158 protrudes through the hole 434 and into the lower entry aperture 418.

In an embodiment, as shown in FIG. 1, the post support assembly 150 can be configured to be insertable into the hollow interior 212 of a bottom post member 122 of the signpost assembly 102;

such that the post support assembly 150 can secure the signpost assembly 102 in an upright position when the post support assembly 150 is secured to the ground surface 180.

Here has thus been described a multitude of embodiments of the realtor signpost system, and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent and should be considered fully included in this specification and the claims appended hereto. Accordingly, since numerous modifications and variations will readily occur to those skilled in the art, the invention is not limited to the exact construction and operation illustrated and described, and thus, all suitable modifications and equivalents may be resorted to, falling within the scope of the invention.

What is claimed is:

1. A signpost system, comprising:

a) a signpost assembly, which comprises:

a vertical post, which comprises:

a plurality of post members, which are hingedly connected, such that the vertical post is foldable for storage and transportation, and a plurality of hinge cap assemblies, each comprising:

a bottom hinge cap piece, wherein the bottom hinge cap piece is configured to be slidably attachable to an upper end of a respective lower post member; and a top hinge cap piece, wherein the top hinge cap piece is configured to be slidably attachable to a lower end of a respective upper post member:

such that the top hinge cap piece is hingedly connected to the bottom hinge cap piece; and such that the hinge cap assemblies hingedly connect the post members; and a horizontal bar, such that the horizontal bar is configured to attach to the vertical post, such that the horizontal bar is perpendicular to the vertical post; and b) a post support assembly, which is configured such that a lower end of the post support assembly is insertable into a ground surface;

such that a lower end of the vertical post is configured to be detachably attachable to an upper end of the post support assembly, such that the vertical post is secured in an upright position by the post support assembly, when the lower end of the post support assembly is inserted into the ground surface.

2. The signpost system of claim 1, further comprising:

a plurality of sign hooks, which are configured to be slidably connected to the horizontal bar, wherein the sign hooks are configured to detachably attach to a sign, such that the sign is hanging from the horizontal bar.

3. The signpost system of claim 2, further comprising the sign, wherein the sign hooks are detachably attached to the sign.

4. The signpost system of claim 2, wherein the horizontal bar is configured with a hollow interior, wherein the horizontal bar further comprises:

a plurality of lower apertures, which are positioned on a lower surface of the horizontal bar, such that the lower apertures provide access to the hollow interior of the horizontal bar;

wherein each sign hook comprises:

a rectangular plate; and a hook, which is attached to a bottom side of the rectangular plate;

wherein the rectangular plate is slidably mounted inside the horizontal bar, such that the hook protrudes through a corresponding lower aperture in the plurality of lower apertures.

5. The signpost system of claim 1, wherein the horizontal bar is hingedly connected to the vertical post, such that the signpost assembly is foldable for storage and transportation.

6. The signpost system of claim 1, wherein the plurality of post members each include a hollow interior.

7. The signpost system of claim 1, wherein each hinge cap assembly comprises:

a) the top hinge cap piece, which comprises:

a top hinge cap body; and a plurality of top hinge portions, which protrude from a lower portion of a vertical surface of the top hinge cap body;

and b) a bottom hinge cap piece, which comprises:

a bottom hinge cap body; and a plurality of bottom hinge portions, which protrude from an upper portion of a vertical surface of the bottom hinge cap body;

wherein the top hinge portions and the bottom hinge portions are configured to interlock, such that the top hinge portions and the bottom hinge portions form a hinge assembly.

8. The signpost system of claim 7, wherein each hinge cap assembly further comprises:

a hinge pin, which is configured to match a receiving interior of the hinge assembly, such that the hinge pin secures the top hinge portions and bottom hinge portions of the bottom hinge cap piece together;

wherein the hinge assembly further comprises the receiving interior, such that the top hinge cap piece and the bottom hinge cap piece are rotatable relative to the hinge pin.

9. The signpost system of claim 1, wherein each hinge cap assembly comprises:

a) a top hinge cap piece, which comprises:

a top hinge cap body; and a top locking pin tab, which protrudes from a lower portion of a vertical surface of the top hinge cap body;

wherein the top locking pin tab includes a top locking pin hole, such that the top locking pin hole protrudes through the top locking pin tab; and b) a bottom hinge cap piece, which comprises:

a bottom hinge cap body; and a bottom locking pin tab, which protrudes from an upper portion of a vertical surface of the top hinge cap body;

wherein the top locking pin tab includes a bottom locking pin hole, such that the top locking pin hole protrudes through the bottom locking pin tab; and c) a locking pin, which is configured to match the top locking pin hole and bottom locking pin hole, such that the locking pin is insertable into the top locking pin tab and bottom locking pin tab;

whereby the top hinge cap piece and bottom hinge cap piece are rotated such that the top locking pin tab and bottom locking pin tab align, such that the locking pin is insertable through both the top locking pin tab and bottom locking pin tab, wherein the locking pin secures the top hinge cap piece and the bottom hinge cap piece in place.

10. The signpost system of claim 1, wherein the horizontal bar is configured with a hollow interior, wherein the signpost system further comprises:

a) a first end cap, which is detachably attachable to a first end of the horizontal bar; and b) a second end cap, which is detachably attachable to a second end of the horizontal bar;

such that removal of at least one of the first end cap and the second end cap provides access to the hollow interior, which functions as a storage cavity.

11. The signpost system of claim 1, wherein the post support assembly further comprises:

a) a stud member; and b) a ground spike, which is connected to a lower end of the stud member, such that the ground spike is configured to be detachably insertable into the ground surface.

12. The signpost system of claim 11, wherein the stud member comprises:

a) a lower receiving interior; and b) a lower entry aperture on a lower surface of the stud member, such that the lower entry aperture provides access to the lower receiving interior;

wherein an upper portion of the ground spike is configured to match the lower receiving interior, such that the upper portion is detachably attachable to the stud member;

wherein the ground spike secures the stud member in an upright position when the ground spike is inserted into the ground surface.

13. The signpost of claim 12, wherein the lower receiving interior of the stud member is configured as a threaded hole, and an upper portion of the ground spike is configured as a threaded rod that matches the threaded hole of the lower receiving interior, such that the ground spike is secured to the stud member by screwing the upper portion of the ground spike into the lower receiving interior of the stud member.

14. The signpost system of claim 11, wherein the stud member further comprises:

a lateral aperture, which protrudes laterally through the stud member;

wherein the post support assembly further comprises:

a removable step bar, which is insertable through the lateral aperture, such that first and second protruding ends of the removable step bar protrude from the stud member;

whereby the first and second protruding ends of the removable step bar are usable as handles or steps, to push the ground spike into the ground surface, when the ground spike is attached to the stud member, such that the removable step bar aids in the insertion of the ground spike into the ground surface.

15. The signpost system of claim 11, wherein the post support assembly further comprises:

a retention plate, which is positioned between the stud member and the ground spike, such that that the retention plate prevents the stud member from being inserted into the ground surface;

wherein the retention plate comprises a hole, which is configured to match an upper portion of the ground spike and the lower entry aperture of the stud member, such that the upper portion of the ground spike protrudes through the hole and into the lower entry aperture.

16. A signpost system, comprising:

a post support assembly, which is configured such that a lower end of the post support assembly is insertable into a ground surface; and a signpost assembly, which comprises:

a vertical post, which comprises:

a plurality of post members, which are hingedly connected, such that the vertical post is foldable for storage and transportation, and a plurality of hinge cap assemblies, each comprising:

a bottom hinge cap piece, wherein the bottom hinge cap piece is configured to be slidably attachable to an upper end of a respective lower post member; and a top hinge cap piece, wherein the top hinge cap piece is configured to be slidably attachable to a lower end of a respective upper post member:

such that the top hinge cap piece is hingedly connected to the bottom hinge cap piece; and such that the hinge cap assemblies hingedly connect the post members; and such that an upper end of the post support assembly is configured to detachably attach to a lower end of the vertical post, such that the vertical post is secured in an upright position by the post support assembly, when the lower end of the post support assembly is inserted into the ground surface.

17. The signpost system of claim 16, wherein the post support assembly comprises:

a) a stud member; and b) a ground spike, which is connected to a lower end of the stud member, such that the ground spike is configured to be detachably insertable into the ground surface.

18. The signpost system of claim 17, wherein the stud member comprises:

a) a lower receiving interior; and b) a lower entry aperture on a lower surface of the stud member, such that the lower entry aperture provides access to the lower receiving interior;

wherein an upper portion of the ground spike is configured to match the lower receiving interior, such that the upper portion is detachably attachable to the stud member;

wherein the ground spike secures the stud member in an upright position when the ground spike is inserted into the ground surface.

19. The signpost system of claim 18, wherein the lower receiving interior of the stud member is configured as a threaded hole, and an upper portion of the ground spike is configured as a threaded rod that matches the threaded hole of the lower receiving interior, such that the ground spike is secured to the stud member by screwing the upper portion of the ground spike into the lower receiving interior of the support stud.

20. The signpost system of claim 19, wherein the stud member further comprises:

a lateral aperture, which protrudes laterally through the stud member;

wherein the post support assembly further comprises:

a removable step bar, which is insertable through the lateral aperture, wherein the removable step bar is configured to be longer than the lateral aperture, such that first and second protruding ends of the removable step bar protrude from the stud member;

whereby the first and second protruding ends of the removable step bar are usable as handles or steps, to push the ground spike into the ground surface, when the ground spike is attached to the stud member, such that the removable step bar aids in the insertion of the ground spike into the ground surface.

21. The signpost system of claim 20, wherein the post support assembly further comprises:

a retention plate, which is positioned between the stud member and the ground spike, such that that the retention plate prevents the stud member from being inserted into the ground surface;

wherein the retention plate comprises a hole, which is configured to match the upper portion of the ground spike and the lower entry aperture of the stud member, such that the upper portion of the ground spike protrudes through the hole and the lower entry aperture.

22. The signpost system of claim 16, wherein the signpost assembly further comprises:

a horizontal bar, such that the horizontal bar is configured to detachably attach to the vertical post, such that the horizontal bar is perpendicular to the vertical post.

* * * * *